US006957547B2

(12) United States Patent
Goodman

(10) Patent No.: US 6,957,547 B2
(45) Date of Patent: Oct. 25, 2005

(54) VARIABLE CAPACITY CONDENSING UNIT

(75) Inventor: Henry C. Goodman, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 18 days.

(21) Appl. No.: 10/664,178

(22) Filed: Sep. 17, 2003

(65) Prior Publication Data

US 2005/0076663 A1 Apr. 14, 2005

(51) Int. Cl.[7] ..... F25D 19/00; F25D 23/12; F25B 39/04; A47B 43/00

(52) U.S. Cl. ..... 62/298; 62/508; 62/259.1; 62/295; 312/257.1

(58) Field of Search ..... 62/298, 508, 259.1, 62/295; 312/257.1

(56) References Cited

U.S. PATENT DOCUMENTS 5,221,192 A * 6/1993 Heflin et al. ..... 417/363
5,306,121 A * 4/1994 Heflin et al. ..... 417/363
5,437,164 A * 8/1995 Consiglio ..... 62/259.1
5,699,992 A * 12/1997 Hauser ..... 248/635
5,953,929 A 9/1999 Bauman et al. ..... 62/259.1
6,343,481 B2 * 2/2002 Simmons et al. ..... 62/298
6,662,588 B2 * 12/2003 Houk et al. ..... 62/298
6,701,739 B2 * 3/2004 Morse ..... 62/277
6,705,105 B2 * 3/2004 Wendt et al. ..... 62/298

* cited by examiner

*Primary Examiner*—Cheryl Tyler
*Assistant Examiner*—Filip Zec
(74) *Attorney, Agent, or Firm*—Patrick M. Griffin

(57) ABSTRACT

A condensing unit that is adapted to receive compressors and condensers of varying dimensions. A base of the condensing unit supports a compressor having a predefined dimension and a condenser having a predefined dimension. The base includes a plurality of mounting mechanisms. The compressor engages one of the plurality of mounting mechanisms depending on the predefined dimension of the compressor. The base also defines a plurality of inner and outer support channels adjacent one another about a periphery of the base. The condenser is supported by one of the support channels depending on the predefined dimension of the condenser.

28 Claims, 6 Drawing Sheets

116
114
116
108
110
116
116
113
111
28
100
116
102
112
38
106
106
104
106
36
24
92
92
92
88
6
88
88
86
86
98
86
36
98
98
50
22
52
90
5
90
66c
80
66b
66b
70
66c
36
12
42
90
36
80
68
64
78
68
54
70
82
40
82
80

VARIABLE CAPACITY CONDENSING UNIT

FIELD OF THE INVENTION

The present invention generally relates to a condensing unit for use in an air conditioning system. More specifically, the present invention relates to a variable capacity condensing unit for use in the air conditioning system.

BACKGROUND OF THE INVENTION

Condensing units are well known for removing heat from refrigerant being circulated in a refrigerant circuit to cool a climate-controlled area. A typical condensing unit includes a compressor for compressing the refrigerant in the refrigerant circuit and a condenser, which receives the compressed refrigerant from the compressor and cools and condenses the refrigerant. The refrigerant, once condensed, is conveyed to an evaporator unit. The evaporator unit is positioned inside the climate-controlled area and includes an evaporator for transferring heat from air in the climate-controlled area to the refrigerant. The condensing unit is typically outside of the climate-controlled area and serves to compress and cool the refrigerant after the evaporator has transferred the heat from the air to the refrigerant. In essence, the condensing unit dispenses the heat of the air in the climate-controlled area to outside of the climate-controlled area.

Condensing units can come in a wide variety of capacities depending upon the particular application and the cooling power required. As a result, installers must maintain a large inventory of condensing units to accommodate their customers. As can be appreciated, such a large inventory can reduce efficiency and profitability. As a result, there is a need in the art for variable capacity condensing units that can be easily assembled based on the particular use to which the condensing unit is being applied.

One attempt at meeting this need is shown in U.S. Pat. No. 5,953,929 to Bauman et al. Bauman et al. discloses a modular refrigeration unit. In Bauman et al., the components of the refrigeration unit include an evaporator, condenser, and compressor, which can be easily assembled for quick installations. Bauman et al., however, does not teach a modular refrigeration unit that can accommodate components of varying dimensions.

The ability to accommodate components of varying dimensions would allow installers to maintain smaller inventories, while accommodating the same customers. For instance, in a first application, the customer's condensing unit may require a compressor having a small compression rate, while in a second application, the condensing unit may require a larger compressor having a larger capacity. Similarly, in the first application, the condensing unit may require a condenser having a large capacity, while in the second application, the condensing unit may require a smaller condenser having a small capacity. Typically, the condensing unit includes a base to support the compressor and condenser, but the base is configured to receive only one dimension of compressor and condenser. If the condensing unit were configured to accommodate varying dimensions of compressors and condensers, then the installer would not have to store different condenser units that have different compressors and condensers of varying dimensions to meet their customer's needed cooling capacity. Instead, the installer could inventory one chassis and customize the chassis based on the cooling capacity needed.

SUMMARY OF THE INVENTION AND ADVANTAGES

The present invention provides a condensing unit for removing heat from refrigerant being circulated in a refrigerant circuit to cool a climate-controlled area. The condensing unit comprises a compressor having a predefined dimension to compress the refrigerant and a condenser having a predefined dimension in fluid communication with the compressor to cool and condense the refrigerant. A base supports the compressor and condenser. The base includes first and second mounting mechanisms wherein the compressor is secured to one of the mounting mechanisms depending on the predefined dimension of the compressor. The base also defines inner and outer support channels wherein one of the support channels supports the condenser depending on the predefined dimension of the condenser.

The present invention provides the ability to accommodate components of varying dimensions to allow installers to maintain smaller inventories, while accommodating the same customers. By utilizing the mounting mechanisms and the support channels, the condensing unit is configured to accommodate compressors and condensers of varying dimensions. Hence, the installer does not have to store multiple condenser units of varying capacity to meet their client's particular cooling needs. Instead, the installer can inventory one chassis for the condensing unit and customize the chassis based on required cooling needs.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
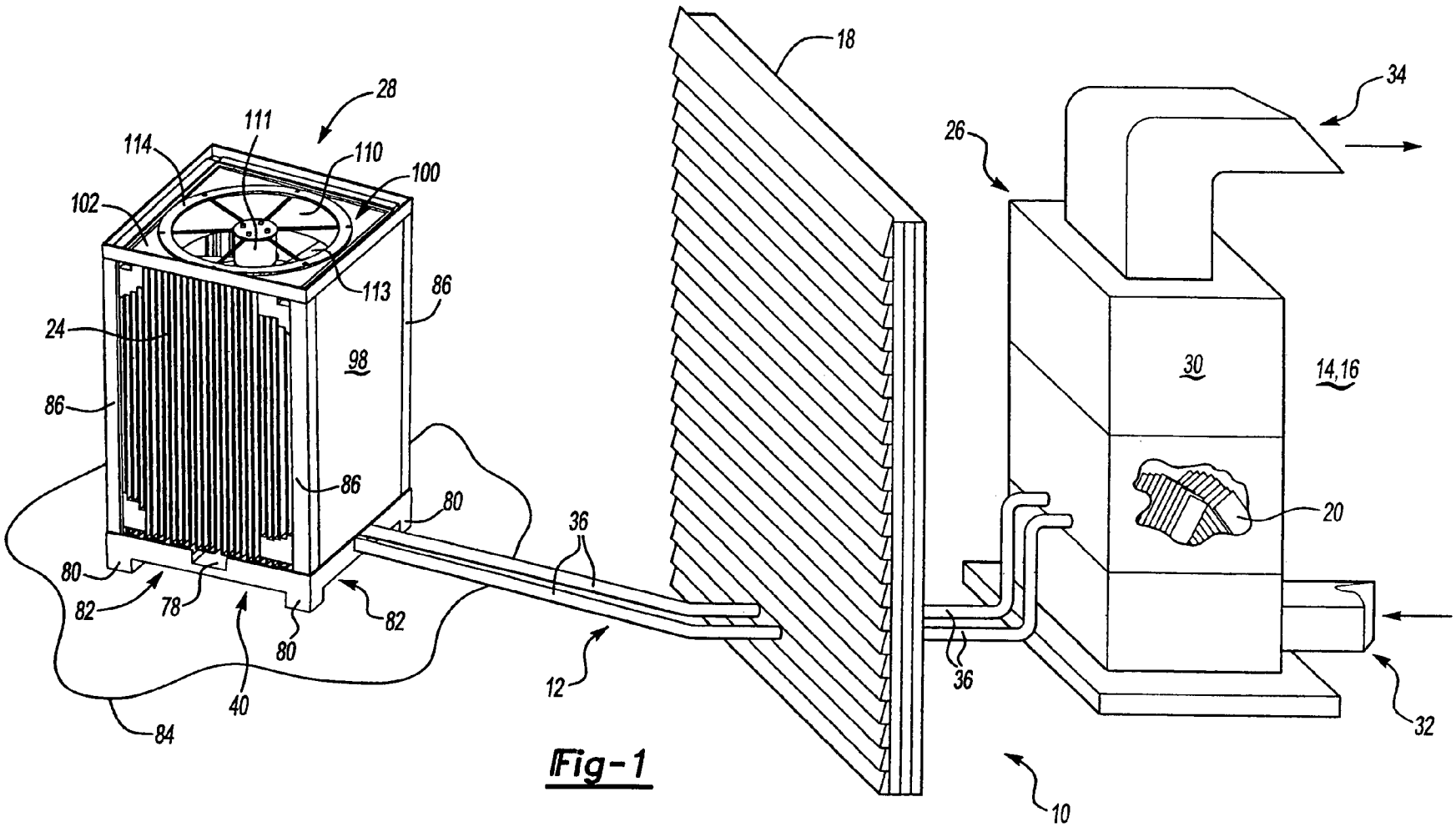
FIG. 1 is a perspective view of an air conditioning system of the present invention.

Referring to the Figures, wherein like numerals indicate like or corresponding parts throughout the several views, an air conditioning system is generally shown at 10. Referring to FIG. 1, the air conditioning system 10 comprises a circuit 12 to transport refrigerant, e.g., carbon dioxide, R134A, R410A, or any other fluid capable of heat transfer, to various components of the air conditioning system 10 to facilitate removal of the heat from the air in a climate-controlled area 14, i.e., to cool the climate-controlled area 14. It should be appreciated that while the embodiment illustrated herein shows the air conditioning system 10 being used to cool an interior 16 of a building 18, the present invention should not be so limited. For instance, the air conditioning system 10 could also be utilized in any commercial or domestic refrigeration units, such as meat lockers and the like. Likewise, it should also be appreciated that the components of the air conditioning system 10 that are in fluid communication with the refrigerant circuit 12 are generally illustrated. In other words, the present invention is not limited to the particular configuration of the refrigerant circuit 12 and the components attached thereto.

Figure 2:
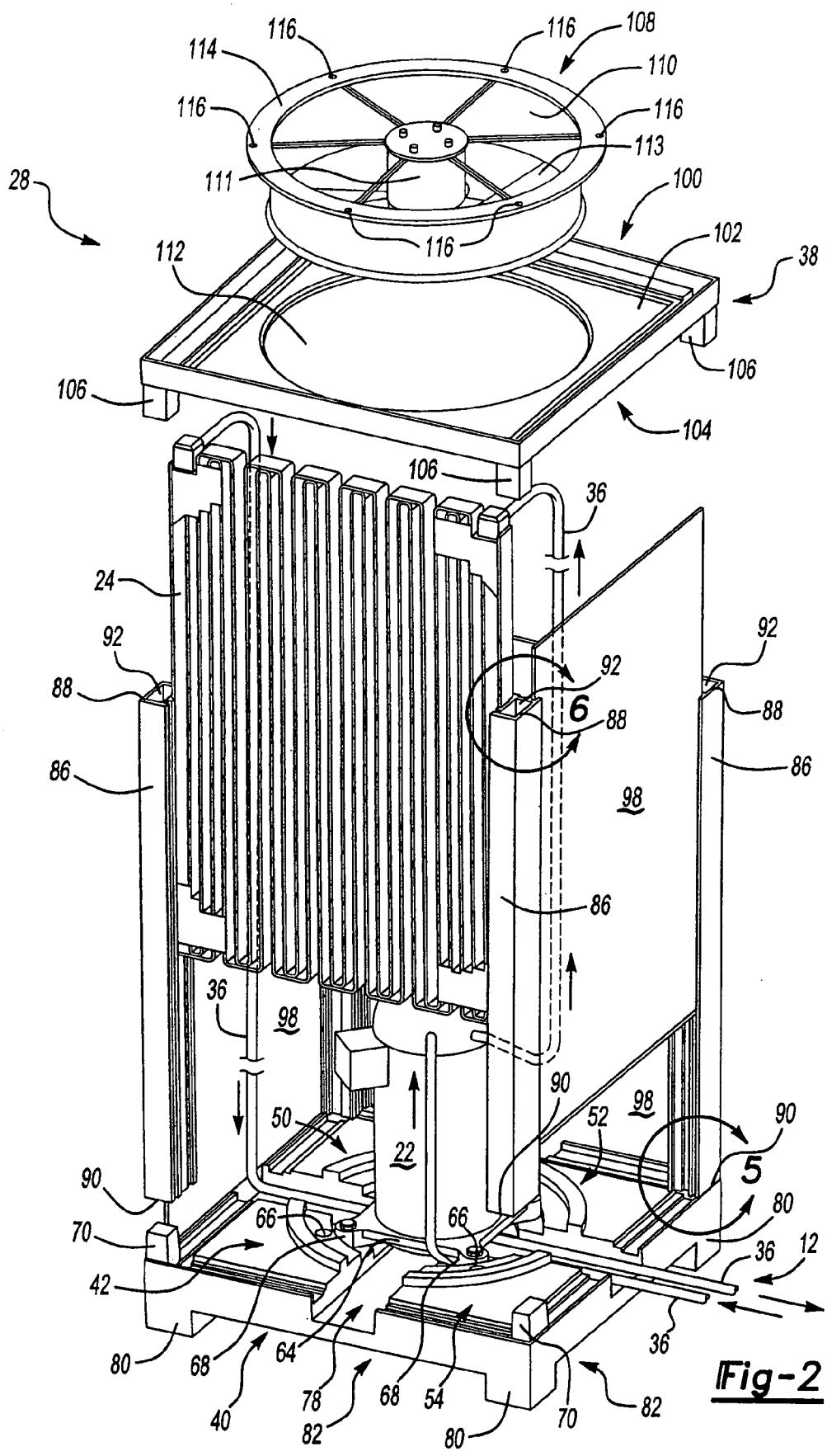
FIG. 2 is a partially-assembled, partially-exploded, perspective view of a condensing unit of the present invention.

Generally speaking, the components of the air conditioning system 10 include an evaporator 20 in fluid communication with the refrigerant circuit 12 to transfer the heat from the air in the climate-controlled area 14 to the refrigerant. Referring to FIG. 2, a compressor 22 is in fluid communication with the refrigerant circuit 12 to receive the refrigerant from the evaporator 20 and compress the refrigerant in the refrigerant circuit 12. A heat exchanger 24 is in fluid communication with the refrigerant circuit 12 to cool and condense the refrigerant from the compressor 22, or to simply cool the refrigerant. As will be appreciated by those skilled in the art, the heat exchanger 24 can be further defined as either a condenser 24, or a gas cooler 24 when carbon dioxide is the refrigerant, i.e., cooling medium. For purposes of the description, the heat exchanger 24 shall be defined as the condenser 24. Once the refrigerant is cooled, the refrigerant is cycled back to the evaporator 20. As will be appreciated by those skilled in the art, additional components could be included in the refrigerant circuit 12. For instance, an expansion device such as an orifice tube could be positioned between the condenser 24 and the evaporator 20 to expand the cooled refrigerant from the condenser 24. Likewise, an accumulator-dehydrator could be positioned between the evaporator 20 and the compressor 22 to separate liquid and gas refrigerant from the evaporator 20. Of course, other configurations and/or components may also be employed.

The air conditioning system 10 can be separated into two basic units, an evaporator unit 26 and a condensing unit 28. Referring back to FIG. 1, the evaporator unit 26 is typically positioned inside the climate-controlled area 14 and includes the evaporator 20 to transfer the heat from the air in the climate-controlled area 14 to the refrigerant. An enclosure 30 surrounds the evaporator 20 and defines an inlet air duct 32 and a supply air duct 34. A fan unit (not shown) is positioned within the enclosure 30 to draw in air from the climate-controlled area 14 though the inlet air duct 32 and blow the air across the evaporator 20 and back to the climate-controlled area 14 via the supply air duct 34. As the air moves across the evaporator 20, the refrigerant absorbs the heat from the air, thus cooling the air that is returned to the climate-controlled area 14.

Referring now to FIGS. 1 and 2, the condensing unit 28 is typically positioned outside of the climate-controlled area 14 and includes the compressor 22, which receives the refrigerant from the evaporator 20 in the evaporator unit 26 and compresses the refrigerant. The condensing unit 28 also includes at least one condenser 24 that serves to cool and condense the gas refrigerant from the compressor 22. The refrigerant circuit 12 comprises a plurality of fluid conduits 36 to convey the refrigerant between the evaporator 20 and the compressor 22, between the compressor 22 and the condenser 24, and between the condenser 24 and the evaporator 20. The fluid conduits 36 may comprise any suitable material utilized in air conditioning systems 10 including copper tubing, multi-layered rubber hoses, and the like.

Figure 3:
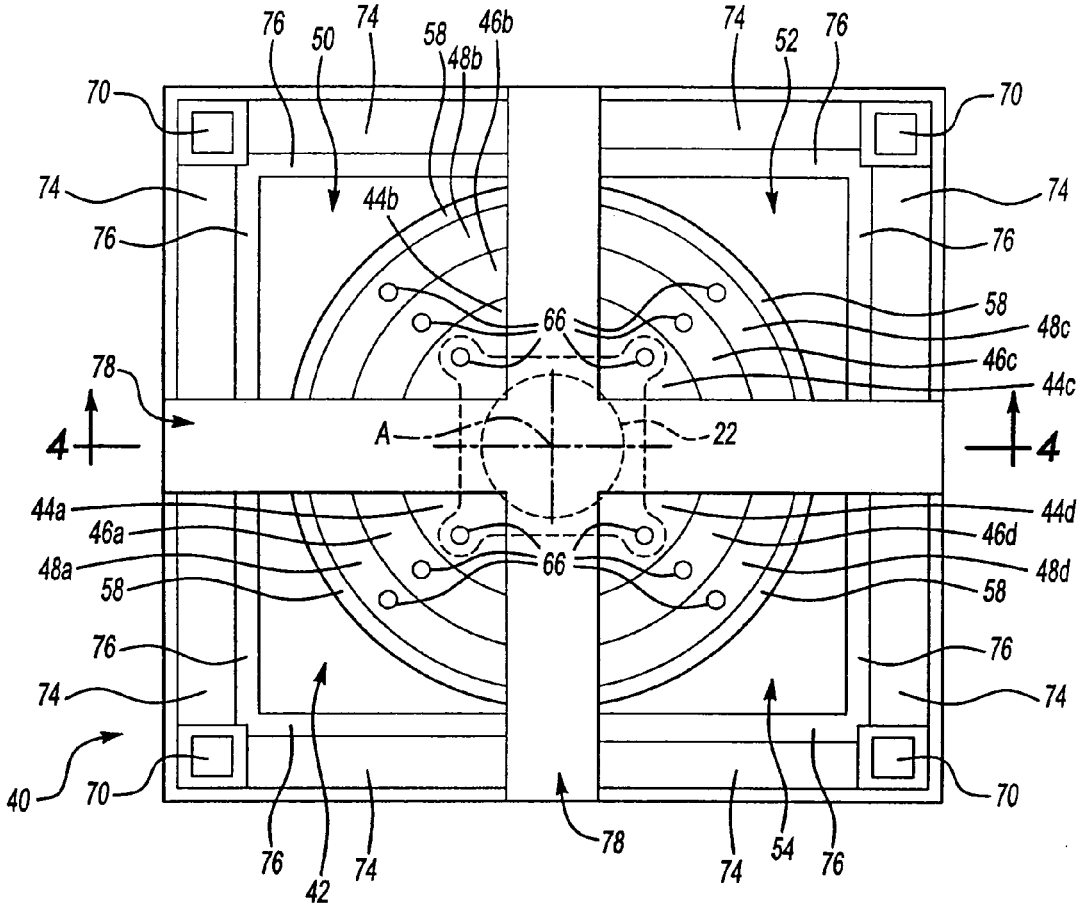
FIG. 3 is a top view of a base of the condensing unit of the present invention.
Figure 4:
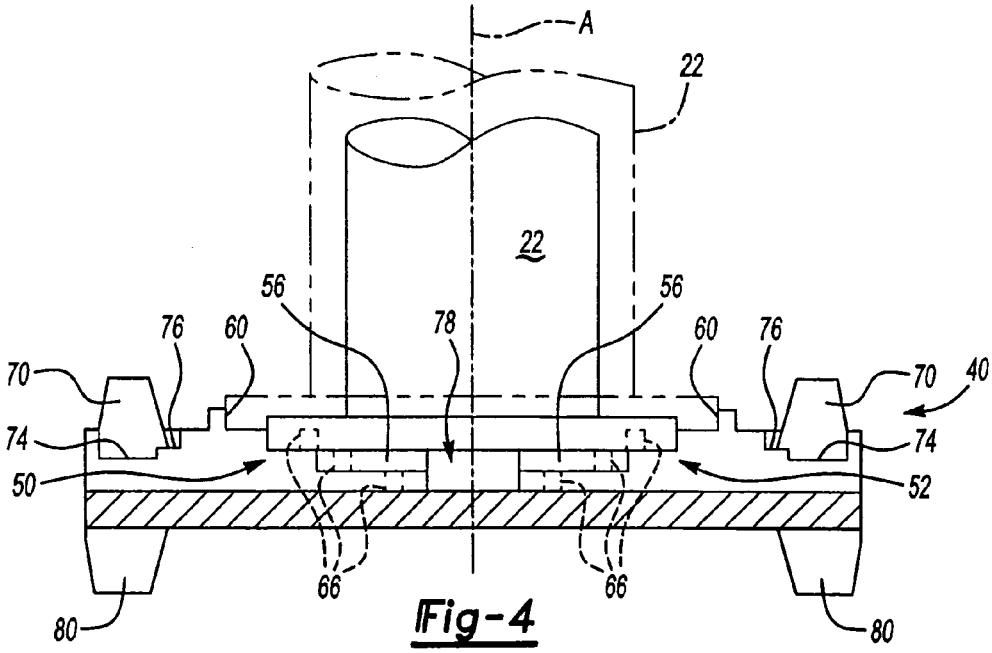
FIG. 4 is a cross-sectional view of the base of the condensing unit as viewed along the line 4—4 in FIG. 3.

A multi-piece chassis 38 supports and protects the compressor 22 and condenser 24. Referring to FIGS. 3 and 4, the chassis 38 comprises a base 40 to support the compressor 22 and condenser 24. The base 40 includes a vertical axis A extending through a central point of the base 40. Preferably, the base 40 comprises blow-molded plastic and is hollow. The base 40 may be filled with a substance, e.g., water or sand, to provide weight to secure the base 40 in position. The base 40 could also be solid and stamped, or solid and formed from injection-molded plastic.

The base 40 includes a plurality of mounting mechanisms to adapt the base 40 to receive compressors of varying dimensions. The compressor has a predefined dimension and the compressor 22 engages one of the mounting mechanisms based on the predefined dimension. In other words, the particular mounting mechanism used to secure the compressor 22 to the base 40 is based on the predefined dimension. Referring specifically to FIG. 3, the mounting mechanisms are further defined as mounting platforms 44*a–d*,46*a–d*, 48*a–d*. A first mounting mechanism is a first mounting platform 44*a–d*, which is shown supporting the compressor 22 on the vertical axis A in FIG. 3. A second mounting mechanism is a second mounting platform 46*a–d* that surrounds the first mounting platform 44*a–d* and is upwardly and outwardly stepped from the first mounting platform 44*a–d* to support the compressor 22 on the vertical axis A when the compressor 22 has a larger predefined dimension. See FIGS. 2 and 4. A third mounting mechanism is a third mounting platform 48*a–d* that surrounds the second mounting platform 46*a–d* and is upwardly and outwardly stepped from the second mounting platform 46*a–d* to support the compressor on the vertical axis A when the compressor 22 has an even larger predefined dimension. See the hidden lines in FIG. 4. Hence, the plurality of mounting mechanisms comprises the first 44*a–d*, second 46*a–d*, and third 48*a–d* mounting platforms to adapt the base 40 to receive compressors of varying dimensions. The first 44*a–d*, second 46*a–d*, and third 48*a–d* mounting platforms lie in first, second, and third planes that are parallel and equally spaced from one another.

In the preferred embodiment, the base 40 is segmented into four mounting segments or portions 42,50,52,54 in four symmetrical and equally spaced quadrants. Each of the mounting portions 42,50,52,54 have a plurality of mounting surfaces 44*a–d*, 46*a–d*, 48*a–d* that define the platforms 44*a–d*,46*a–d*,48*a–d*. It should be appreciated that the present invention could be accomplished using any number of mounting portions 42,50,52,54 and mounting surfaces 44*a–d*,46*a–d*,48*a–d*, but is preferably accomplished using three or more of each.

A first mounting portion 42 includes a first plurality of mounting surfaces 44*a*,46*a*,48*a* upwardly and outwardly stepped from one another relative to the vertical axis A. A second mounting portion 50 is spaced from the first mounting portion 42. The second mounting portion 50 includes a second plurality of mounting surfaces 44*b*,46*b*,48*b* that are upwardly and outwardly stepped from one another relative to the vertical axis A. A third mounting portion 52 is spaced from the first 42 and second 50 mounting portions. The third mounting portion 52 includes a third plurality of mounting surfaces 44*c*,46*c*,48*c* that are upwardly and outwardly stepped from one another relative to the vertical axis A. A fourth mounting portion 54 is spaced from the first 42, second 50, and third 52 mounting portions. The fourth mounting portion 54 includes a fourth plurality of mounting surfaces 44*d*,46*d*,48*d* that are upwardly and outwardly stepped from one another relative to the vertical axis A. As mentioned, the first 42, second 50, third 52, and fourth 54 mounting portions are equally and symmetrically disposed about the base 40 and each of the mounting portions 42,50,52,54 are of equal size and dimension.

Each of the mounting portions 42,50,52,54 includes a plurality of curved front faces 56 perpendicular to the mounting surfaces 44*a–d*, 46*a–d*, 48*a–d*. The curved front faces 56 interconnect each of the mounting surfaces 44*a–d*, 46*a–d*, 48*a–d* to further define the mounting platforms 44*a–d*,46*a–d*,48*a–d* as steps of each mounting portion 42,50,52,54. In essence, each mounting portion 42,50,52,54 resembles a staircase having curved steps defining arcs of concentric circles that increase in length with each higher step. More specifically, the curved front faces 56 of each mounting portion 42,50,52,54 define arcs of the same concentric circles. In other words, the curved front faces 56 of one mounting portion 42 are spaced from the vertical axis A of the base 40 in the same manner as all other mounting portions 50,52,54.

A rim 58 surrounds each of the third or uppermost mounting surfaces 48*a–d* of each mounting portion 42,50, 52,54. Each rim 58 has a curved front face 60 and a curved back face 62 to provide support to the compressor 22 when the compressor 22 is mounted to the third or uppermost mounting surfaces 48*a–d* of each mounting portion 42,50, 52,54.

Referring to FIGS. 2 and 4, the compressor 22 includes a bracket 64 engaging each of the mounting portions 42,50, 52,54 on one of the first 44*a–d*, second 46*a–d*, and third 48*a–d* mounting platforms. The bracket 64 is supported by one of the mounting surfaces 44*a–d*, 46*a–d*, 48*a–d* of each mounting portion 42,50,52,54.

Referring specifically to FIG. 3, a plurality of insert-molded fasteners 66 are molded into each of the mounting portions 42,50,52,54 at each of the mounting surfaces 44*a–d*, 46*a–d*, 48*a–d* to facilitate fastening of the bracket 64 to the mounting portions 42,50,52,54. Preferably, the insert-molded fasteners 66 are nuts, and bolts are used to secure the bracket 64 of the compressor 22 to the mounting portions 42,50,52,54. The bracket 64 includes a plurality of arms 68 radially extending therefrom with each of the arms 68 defining a bore therein. The bolts are placed through the bores into the insert-molded nuts 66 and tightened into position to secure the compressor 22 to the mounting portions 42,50,52,54.

Figure 2A:
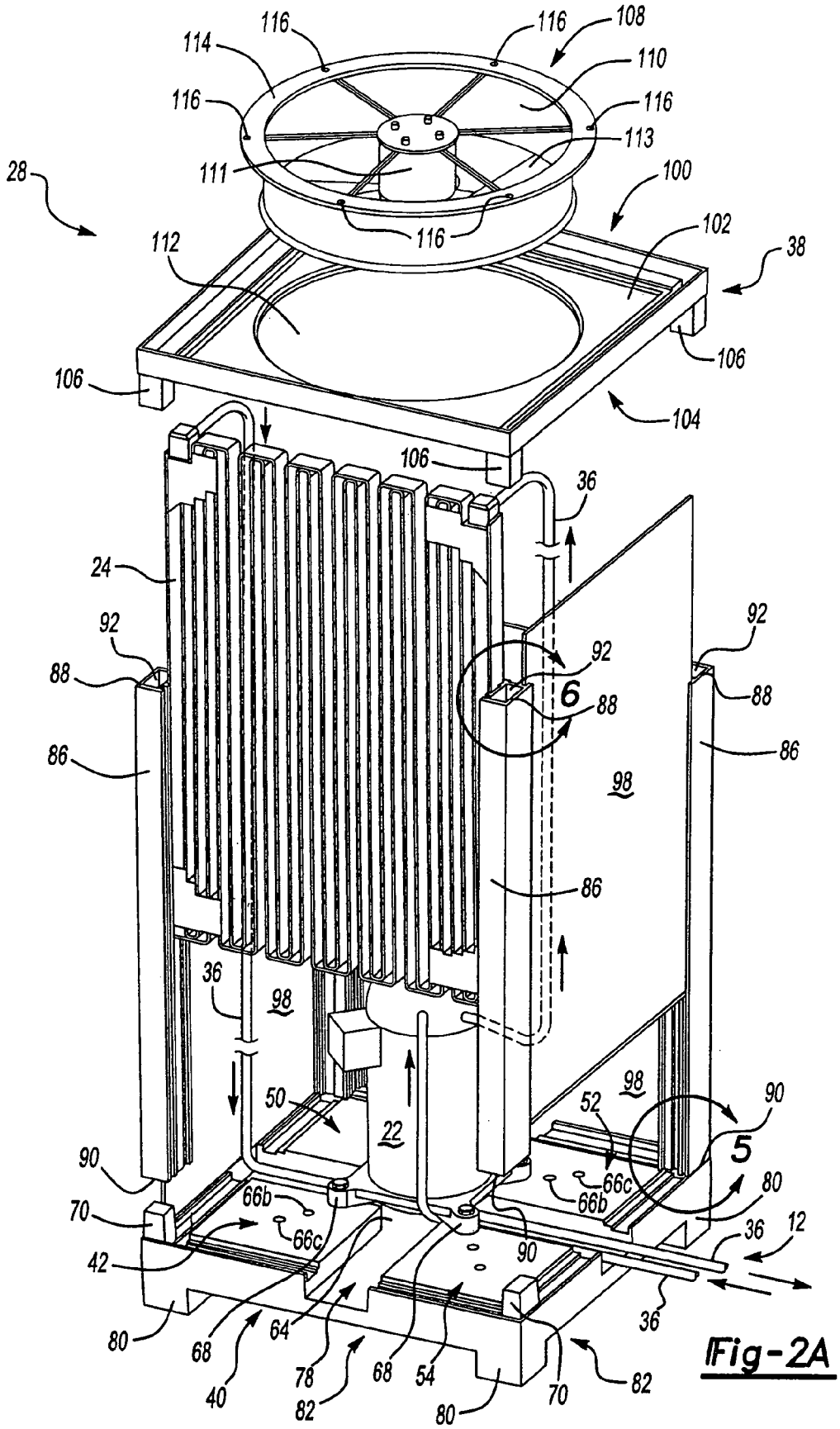
FIG. 2A is a partially-assembled, partially-exploded, perspective view of a condensing unit of an alternative embodiment of the present invention.
Figure 3A:
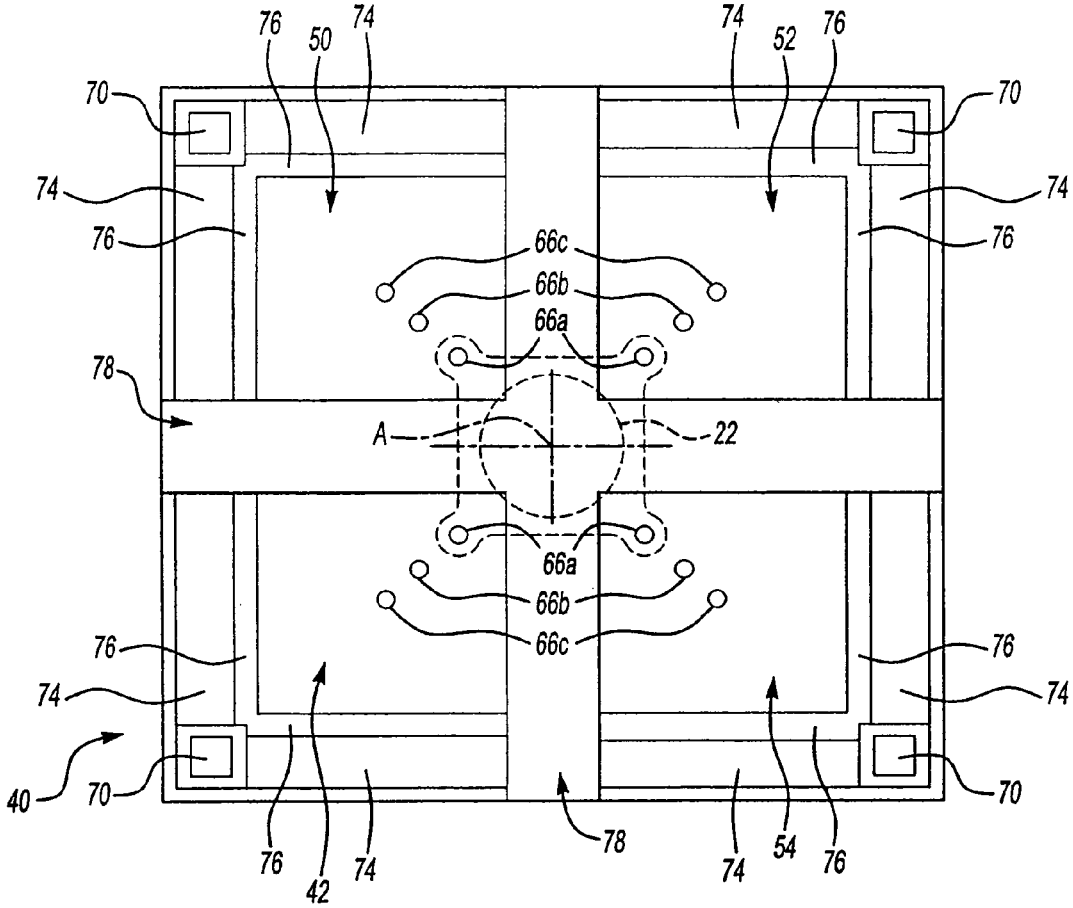
FIG. 3A is a top view of a base of the condensing unit of the alternative embodiment of the present invention.

In an alternative embodiment, shown in FIGS. 2A and 3A, the first 44*a–d*, second 46*a–d*, and third 48*a–d* mounting platforms are replaced by a single mounting platform. In this embodiment, the first, second, and third mounting mechanisms are further defined as first 66*a*, second 66*b*, and third 66*c* pluralities of insert-molded fasteners outwardly spaced from the vertical axis A. See FIG. 3A. Hence, the pluralities of insert-molded fasteners 66*a*,66*b*,66*c* adapt the base 40 to receive compressors of varying dimensions. In particular, the insert-molded fasteners 66*a*,66*b*,66*c* are insert-molded nuts 66*a*,66*b*,66*c* and bolts extend through the bracket 64 of the compressor 22 to engage one of the first 66*a*, second 66*b*, and third 66*c* pluralities of insert-molded nuts 66*a*,66*b*,66*c*. The plurality of insert-molded nuts 66*a*,66*b*,66*c* used to secure the compressor 22 to the base 40 depends on the predefined dimension of the compressor 22. The compressor 22 thereby engages one of the pluralities of the insert-molded nuts 66*a*,66*b*,66*c* while the other pluralities can be used to engage the compressor 22 when the compressor 22 has a different predefined dimension.

In another embodiment, the plurality of mounting mechanisms may be further defined as the plurality of arms 68 of the bracket 64 varying in the dimension based on the predefined dimension of the compressor 22. The arms 68 vary in dimension, e.g., width and/or length, to engage fixed bolts on the base 40 to secure the compressor 22 to the base 40.

In still another embodiment, the bracket 64 of the compressor 22 may be removed and the plurality of mounting mechanisms may be a plurality of pockets sized to fit compressors of varying dimensions. In this instance, a rubber gasket or boot slides over the compressor 22 to provide a snug fit in one of the plurality of pockets.

The plurality of mounting mechanisms of all embodiments may be configured to accommodate compressors of varying dimension, e.g., shape and/or size. For instance, each of the first 44*a–d*, second 46*a–d*, and third 48*a–d* mounting platforms could assume a different shape. One could be oval, one circular, and one rectangular. Likewise, the insert-molded fasteners 66*a*,66*b*,66*c* could also for different-shaped patterns to accommodate compressors of varying shape and/or size.

Referring to FIGS. 2–4, in all embodiments, a first plurality of guide posts 70 upwardly extend from the base 40 and are integrally formed with the base 40. The guide posts 70 are generally block-shaped, but decrease slightly in perimeter as they extend upwardly from the base to a top surface to facilitate assembly.

A plurality of support channels for receiving the condenser 24 are defined in the base 40 about a periphery thereof and between the plurality of guide posts 70. More specifically, the base 40 defines outer support channels 74 about the periphery thereof and inner support channels 76 stepped upwardly and inwardly from the outer support channels 74. The condenser 24 has a predefined dimension and is supported by and seated within at least one of the outer 74 and inner 76 support channels based on the predefined dimension. In other words, the condensers 24 may be seated in the deeper, outer support channel 74, or the condenser 24 could be seated in the shallower, inner support channel 76 depending on the predefined dimension. In the latter instance, the condenser 24 spans across the outer support channel 74, but is spaced therefrom to define a small gap. In addition, since the outer 74 and inner 76 support channels are defined on all sides of the base 40, the base 40 is adapted to receive one or more of the condensers 24, in series or parallel, and the sizes of the condensers may be mixed and matched to finish out the condensing unit 28.

The mounting portions 42,50,52,54 define two plumbing channels 78 symmetrically interposed therebetween to further define the quadrants of the base 40. These plumbing channels 78 cross one another at the vertical axis A of the base 40. The plumbing channels 78 are used to route the fluid conduits 36, as shown in FIG. 2, and to route electrical wires/cables. The plumbing channels 78 also interrupt the outer 74 and inner 76 support channels of the base 40 on each side of the base 40. In alternative embodiments, inserts (not shown) could be used to cover ends of the plumbing channels 78 that are not used.

A plurality of legs 80 are integrally formed with the base 40 and downwardly extend therefrom to define a space 82 between the base 40 and a support surface 84. The space 82 facilitates moving the condensing unit 28 with a forklift or the like.

Figure 5:
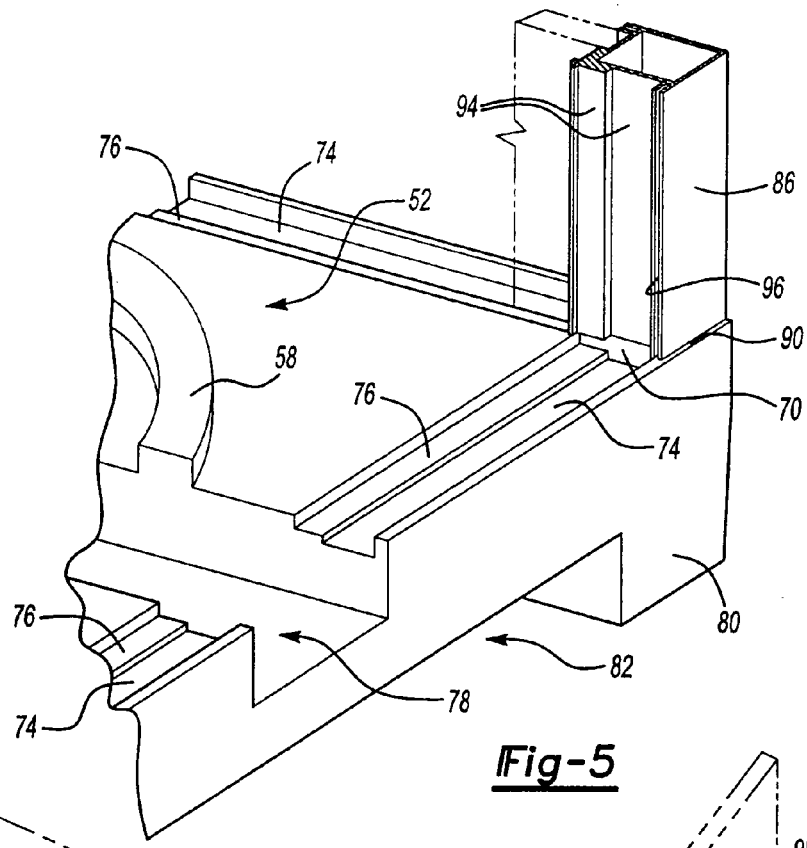
FIG. 5 is a blown-up view of the base of the condensing unit as shown in FIG. 2 illustrating the connection of the base with a guide rail.
Figure 6:
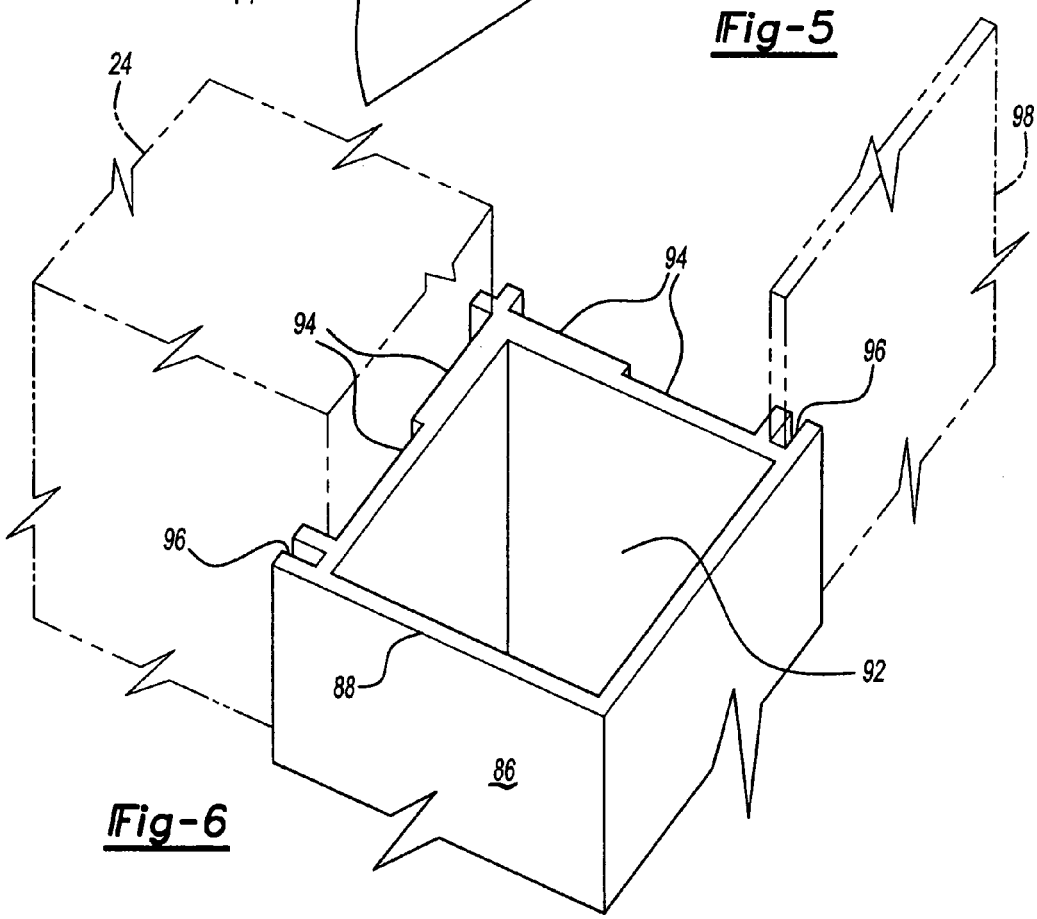
FIG. 6 is a blown-up view of the guide rail of the condensing unit as shown in FIG. 2 illustrating the connection of a condenser and close-out panel to the guide rail.

Referring to FIGS. 2, 5, and 6, the chassis 38 further includes a plurality of guide rails 86, each having proximal 88 and distal 90 ends and defining a central aperture 92 therebetween. The guide rails 86 are in mating engagement with the first plurality of guide posts 70. More specifically, at the distal 90 end of each guide rail 86, the central aperture 92 is positioned over one of the guide posts 70. The guide posts 70 and guide rails 86 are sized to prevent significant lateral movement of the guide rails 86 once in position over the guide posts 70. In the preferred embodiment, four guide rails 86 are supported by four guide posts 70 upwardly extending from the base 40.

Referring specifically to FIGS. 5 and 6, the guide rails 86 define a plurality of receiving channels 94 extending between the proximal 88 and distal 90 ends thereof. The receiving channels 94 are aligned with the outer 74 and inner 76 support channels of the base 40. The condenser 24 is seated within at least one of the support channels 74,76 of the base 40 and at least one of the receiving channels 94 of two guide rails 86. Since, the receiving channels 94 are aligned with the support channels 74,76, the condenser 24 is seated in the receiving channels 94 in the same manner as previously described for the support channels 74,76. For instance, if the condenser 24 is seated within the shallower inner support channel 76, the condenser 24 is also seated within the shallower receiving channel 94, as best shown in FIG. 6. Alternatively, if the condenser 24 is seated within the deeper outer support channel 74, the condenser 24 is seated within the deeper receiving channel 94, as best illustrated by the additional, phantom condenser in FIG. 5.

The condenser 24 interconnects two of the guide rails 86. Referring specifically to FIG. 6, each guide rail 86 has four sides with two of the four sides being finishing sides and the other two sides defining the receiving channels 94. It should be appreciated that in the preferred embodiment, the condensing unit 28 is adapted to receive up to four condensers 24 by way of the receiving channels 94 in the guide rails 86 and the support channels 74,76 in the base 40.

Still referring to FIG. 6, each of the guide rails 86 defines two grooves 96 adjacent to the receiving channels 94 that extend between the proximal 88 and distal 90 ends. Three close-out panels 98 interconnect the guide rails 86 to further define the chassis 38 and enclose the compressor 22. Each close-out panel 98 is seated within one groove 96 of each of two guide rails 86. The close-out panels 98 rest along upper edges of the base 40. The guide rails 86 and close-out panels 98 could be formed from aluminum, plastic, sheet metal, or any other cost-effective material.

It should be appreciated that the close-out panels 98 are used in the condensing unit 28 to finish the sides of the chassis 38 that do not include the condenser 24. In other words, in the case in which the chassis 38 has four sides, as shown in FIG. 2, each of the sides can either include a condenser 24, or a close-out panel 98. In this instance, at least one of the condensers 24 must be positioned on at least one side. Therefore, the three close-out panels 98 finish the other three sides. In alternative embodiments in which two condensers 24 are used, the two condensers 24 would be positioned at two sides and two close-out panels 98 would finish the other two sides. Hence, the condensing unit 28 is modular and interchangeable.

A decorator panel (not shown) could outwardly cover the condenser 24 by sliding the decorator panel into at least one of the grooves 96 of the two guide rails 86 on either side of the condenser 24. Here, the decorator panel includes a substantial amount of air space to allow air to move through the condensing unit 28. The decorator panel could be made from aluminum, plastic, sheet metal, or any other cost-effective material. The decorator panel could be punched out to spell an address or name or to display a design.

Referring to FIGS. 2 and 2A, a cap 100 having upper 102 and lower 104 surfaces is spaced from the base 40 to complete the chassis 38. A second plurality of guide posts 106, similar to the first plurality of guide posts 70, downwardly extend from the cap 100 and are in mating engagement with the central apertures 92 of the guide rails 86 at the proximal 88 ends thereof such that the guide rails 86 interconnect the cap 100 and the base 40. The second plurality of guide posts 106 are spaced and distributed along the lower surface 104 of the cap 100 as though the second plurality of guide posts 106 were mirror images of the first plurality of guide posts 70. The lower surface 104 of the cap 100, in the preferred embodiment, also includes outer and inner support channels (not shown) between the second plurality of guide posts 106 that are mirror images of the outer 74 and inner 76 support channels of the base 40. Again, similar to the base 40, the close-out panels 98 abut lower edges of the cap 100. In essence, the topology of the lower surface 104 of the cap 100 mirrors the topology of the base 40. This symmetry between the cap 100 and the base 40 ensures that the guide rails 86 are perpendicular to the cap 100 and base 40 and the condenser 24 and close-out panels 98 easily and snugly fit between the cap 100 and base 40 to provide a robust structure.

The cap 100 supports a fan unit 108 comprising a fan bracket 110, a fan motor 111, and a fan 113. The cap 100 defines an insert aperture 112 therein for receiving the fan unit 108 and the fan bracket 110 includes a lip 114 for resting on the upper 102 surface of the cap 100 thereby supporting the fan unit 108 such that the fan unit 108 can easily be removed from the cap 100. The fan bracket 110 defines a plurality of mounting bores 116 for fastening the fan bracket 110 to the cap 100. This mounting configuration of the fan unit 108 allows an installer to interchange fan units of varying capacity quickly and easily. For example, different fan and/or motor combinations could be utilized to vary the capacity of the fan unit 108. The fan unit 108 draws air across the condenser 24 to remove heat from the refrigerant in the condenser 24. Holes (not shown) may be drilled in the cap 100 and/or base 40 to facilitate drainage and prevent ponding of water on or in the condensing unit 28.

A control unit (not shown) for controlling the fan motor 111 and compressor motor (not shown) is mounted within the chassis 38. Power supplies to the control unit and/or fan motor 111 and compressor motor can be routed thereto via the plumbing channels 78 defined between the mounting portions 42,50,52,54.

Once assembled, the condensing unit 28 may be secured together by using force-fit connections and conventional mechanical fasteners, as will be appreciated by those skilled in the art.

While the chassis 38 of the condensing unit 28 of the preferred embodiment described herein includes four sides, the present invention should not be so limited. The chassis 38 could include any number of sides to accommodate multiple condensers 24 and/or close-out panels 98. In addition, other configurations could also be anticipated by those skilled in the art in accordance with the teachings of the present invention to adapt the condensing unit 28 to receive one or more condensers 24 and to adapt the condensing unit 28 to accommodate compressors 22 and/or fan units 108 of varying capacities.

By utilizing the plurality of mounting mechanisms, the support channels 74,76, and the mounting configuration of the fan unit 108, several different combinations of compressors, condensers, and/or fan units can be used in the condensing unit 28 to vary efficiency, such as varying a particular seasonal energy efficiency rating (SEER), and/or to vary capacity. Table 1 provides a small sample of the potential combinations that could be used:

TABLE 1

| No. of Condensers | Fan Unit | Compressor |
|---|---|---|
| 1 | Fan A | Compressor A |
| 2 | Fan A | Compressor A |
| 2 | Fan A | Compressor B |
| 2 | Fan B | Compressor B |
| 3 | Fan B | Compressor C |
| 4 | Fan B | Compressor C |
| 4 | Fan C | Compressor D |
| 4 | Fan D | Compressor D |

In addition to the versatility in configuring the condensing unit 28, the condensing unit 28 is also easily upgraded due to its modular and upgradable characteristics. For example, if the climate-controlled area 14 increased in size, e.g., an addition on a home, the condensing unit 28 for that home could be upgraded on-site instead of simply being replaced. A close-out panel 98 or two could be quickly removed and condensers 24 put in their place, the fan unit 108 could be replaced with an increased capacity fan unit 108, and/or the compressor 22 could be upgraded. Thus providing the additional capacity and/or efficiency needed for the home. Of course, given the versatility, adaptability, and upgradability of the condensing unit 28, any new combination is imaginable.

Obviously, many modifications and variations of the present invention are possible in light of the above teachings. The invention may be practiced otherwise than as specifically described within the scope of the appended claims.

What is claimed is:

1. A condensing unit comprising; a compressor having a predefined dimension, a condenser in fluid communication with said compressor for receiving refrigerant from said compressor and cooling the refrigerant, a base supporting said compressor and condenser, said base including a first mounting mechanism comprising a first mounting platform and first fasteners disposed in a first pattern therein, and a second mounting mechanism upwardly and outwardly stepped from said first mounting platform and comprising a second mounting platform and second fasteners disposed in a first pattern therein, wherein said compressor based upon said predefined dimensions engages said first mounting mechanism secured by said first fasteners or said second mounting mechanism secured by said second fasteners.

2. A unit as set forth in claim 1 wherein said base has a vertical axis.

3. A unit as set forth in claim 2 further including a third mounting platform surrounding said second mounting platform and upwardly and outwardly stepped from said second mounting platform.

4. A unit as set forth in claim 3 further including a first mounting portion having a first plurality of mounting surfaces upwardly and outwardly stepped from one another relative to said vertical axis to further define said first, second, and third mounting platforms.

5. A unit as set forth in claim 4 further including a second mounting portion spaced from said first mounting portion and having a second plurality of mounting surfaces upwardly and outwardly stepped from one another relative to said vertical axis to further define said first, second, and third mounting platforms.

6. A unit as set forth in claim 5 further including a third mounting portion spaced from said first and second mounting portions and having a third plurality of mounting surfaces upwardly and outwardly stepped from one another relative to said vertical axis to further define said first, second, and third mounting platforms.

7. A unit as set forth in claim 6 further including a fourth mounting portion spaced from said first, second, and third mounting portions and having a fourth plurality of mounting surfaces upwardly and outwardly stepped from one another relative to said vertical axis to further define said first, second, and third mounting platforms.

8. A unit as set forth in claim 7 wherein said compressor includes a bracket engaging each of said mounting portions on one of said plurality of mounting surfaces.

9. A unit as set forth in claim 8 further including a plurality of insert-molded fasteners molded into each of said mounting portions at each of said mounting surfaces and said compressor is secured to said base by a portion of said plurality of insert-molded fasteners.

10. A unit as set forth in claim 1 wherein said first and second fasteners are further defined as a first and second plurality of insert-molded fasteners molded into said first and second mounting platforms, respectively, wherein said compressor engages one of said first or second pluralities of insert-molded fasteners based on said predefined dimension of said compressor.

11. A unit as set forth in claim 1 wherein said condenser has a predefined dimension and said base defines an inner support channel and an outer support channel adjacent to and stepped downwardly from said inner support channel and said condenser is supported by one of said support channels based on said predefined dimension of said condenser whereby the other of said support channels is used to support said condenser when said condenser has a different predefined dimension.

12. A unit as set forth in claim 11 further including a first plurality of guide posts upwardly extending from said base and integrally formed with said base.

13. A unit as set forth in claim 12 further including a plurality of guide rails, each having proximal and distal ends and defining a central aperture therebetween in mating engagement with said first plurality of guide posts at said distal ends.

14. A unit as set forth in claim 13 further including a cap spaced from said base and having a second plurality of guide posts downwardly extending therefrom for engaging said central apertures of said guide rails at said proximal ends such that said guide rails interconnect said cap and said base.

15. A unit as set forth in claim 14 further including a fan unit comprising a fan bracket supported by said cap wherein said cap defines an insert aperture therein for receiving said fan unit and said fan bracket includes a lip for resting on said cap thereby supporting said fan unit such that fan units of varying capacities can be easily exchanged in said condensing unit.

16. A unit as set forth in claim 1 further including a plurality of legs integrally formed with said base and downwardly extending therefrom for supporting said base and defining a space between said base and a support surface to facilitate moving said condensing unit.

17. A condensing unit comprising;

a compressor for compressing refrigerant, a condenser in fluid communication with said compressor and having a predefined dimension, a base supporting said compressor and said condenser, and said base defining an inner support channel and an outer support channel adjacent to and stepped downwardly from said inner support channel wherein said condenser is supported by one of said support channels based on said predefined dimension whereby the other of said support channels is used to support said condenser when said condenser has a different predefined dimension.

18. A unit as set forth in claim 17 wherein said support channels are defined about a periphery of said base.

19. A unit as set forth in claim 18 wherein said base has a vertical axis and includes a first mounting platform supporting said compressor on said vertical axis and a second mounting platform surrounding said first mounting platform and upwardly and outwardly stepped from said first mounting platform.

20. A unit as set forth in claim 19 further including a first plurality of guide posts upwardly extending from said base and integrally formed with said base.

21. A unit as set forth in claim 20 further including a plurality of guide rails, each having proximal and distal ends and defining a central aperture therebetween in mating engagement with said first plurality of guide posts at said distal ends.

22. A unit as set forth in claim 21 further including a cap spaced from said base and having a second plurality of guide posts downwardly extending therefrom for engaging said central apertures of said guide rails at said proximal ends such that said guide rails interconnect said cap and said base.

23. A unit as set forth in claim 22 further including a fan unit comprising a fan bracket supported by said cap wherein said cap defines an insert aperture therein for receiving said fan unit and said fan bracket includes a lip for resting on said cap thereby supporting said fan unit such that fan units of varying capacities can be easily exchanged in said condensing unit.

24. A unit as set forth in claim 23 wherein said guide rails define a plurality of receiving channels aligned with said support channels of said base.

25. A unit as set forth in claim 24 wherein each of said guide rails further define at least one groove adjacent to one of said receiving channels and extending between said proximal and distal ends.

26. A unit as set forth in claim 25 further including a close-out panel seated within at least one of said grooves of said guide rails.

27. A unit as set forth in claim 1 wherein said base defines a plurality of inner and outer support channels and a second condenser is supported by one of said plurality of inner and outer support channels.

28. An air-conditioning system for use with a cooling medium to cool a climate-controlled area, comprising;

a circuit, a compressor in fluid communication with said circuit for compressing the cooling medium wherein said compressor has a predefined dimension, a heat exchanger in fluid communication with said circuit for receiving the cooling medium from said compressor and cooling the cooling medium wherein said heat exchanger has a predefined dimension, a base supporting said compressor and said heat exchanger, said base including first and second mounting mechanisms wherein said compressor engages one of said mounting mechanisms based on said predefined dimension thereby securing said compressor to said base whereby the other of said mounting mechanisms is used to secure said compressor to said base when said compressor has a different predefined dimension, and said base defining an inner support channel and an outer support channel adjacent to and stepped downwardly from said inner support channel wherein said heat exchanger is supported by one of said support channels based on said predefined dimension of said heat exchanger whereby the other of said support channels is used to support said heat exchanger when said heat exchanger has a different predefined dimension.

* * * * *